US005944143A

United States Patent [19]

Papas et al.

[11] Patent Number: 5,944,143

[45] Date of Patent: Aug. 31, 1999

[54] FAST SERVICE FOOD COURT SYSTEMS AND METHOD OF ESTABLISHING VARIATIONS THEREOF

[75] Inventors: Chris Papas, Pikesville; Antonio DiRico, North Potomac, both of Md.

[73] Assignee: Choice Hotels International, Inc., Silver Spring, Md.

[ * ] Notice: Under 35 U.S.C. 154(b), the term of this patent shall be extended for 51 days.

[21] Appl. No.: 08/522,559

[22] Filed: Sep. 1, 1995

[51] Int. Cl.[6] ..... A47F 10/06

[52] U.S. Cl. ..... 186/44; 186/38

[58] Field of Search ..... 312/198, 116; 186/38, 44

[56] References Cited

U.S. PATENT DOCUMENTS

| | | | |
|---|---|---|---|
| 2,900,045 | 8/1959 | Conklin et al. | 186/44 |
| 3,162,495 | 12/1964 | Swift | 186/44 X |
| 3,170,541 | 2/1965 | Werner | 186/44 |
| 3,378,325 | 4/1968 | Mayer | 312/198 X |
| 3,957,326 | 5/1976 | Molitor | 312/116 X |
| 4,588,047 | 5/1986 | de Reynal de Saint Michel . | |
| 5,163,536 | 11/1992 | Tuhro et al. . | |
| 5,193,648 | 3/1993 | Yuter . | |

FOREIGN PATENT DOCUMENTS

| | | | |
|---|---|---|---|
| 1048586 | 2/1979 | Canada | 312/198 |

OTHER PUBLICATIONS

Arey, Donna; "College Cafeteria Becomes a Keeper", Foodservice Equipment and Supplies Specialist, Apr. 25, 1995, pp. 63–66.

Ward, Brian; "Creelman Goes to Market", Foodservice Equipment and Supplies Specialist, Jul. 25, 1995, pp. 61–64.

Randell Industries Company Advertisement, Foodservice Equipment and Supplies Specialist, Mar. 31, 1995.

Nortake Incorporated Advertisement, Foodservice Equipment and Supplies Specialist, Jan. 25, 1995.

*Primary Examiner*—F. J. Bartuska

*Attorney, Agent, or Firm*—Finnegan, Henderson, Farabow, Garrett & Dunner

[57] ABSTRACT

To permit installations of food court systems at various sites in an expeditious and cost effective manner, freestanding modules for each site are selected from available food court sets, each set consisting of a predetermined equal number of customized modules specially equipped to serve a unique food/beverage product. The modules selected from each set are transported to the respective installation sites where they are arranged to form food court systems according to predetermined food court layouts appropriate for the various installation sites.

12 Claims, 6 Drawing Sheets

FAST SERVICE FOOD COURT SYSTEMS AND METHOD OF ESTABLISHING VARIATIONS THEREOF

FIELD OF THE INVENTION

The present invention relates to the food service industry, and particularly to restaurants, such as food courts, that prepare and serve varieties of fast food and beverage products in an expeditious, efficient, and cost-effective manner.

BACKGROUND OF THE INVENTION

In today's fast paced society, people often cannot afford the time to sit down at a full-service restaurant, wait for someone to take their meal orders, wait further for the meal orders to be prepared and then served at their tables, and then wait again to pay the checks. The need for fast food service is particularly acute in the case of business travelers, and, to a large extent, also vacationers.

Currently, most mid-market hotels run, typically on-premises, full-service restaurants and/or coffee shops catering to their guests. Such full-service food facilities require a considerable number of hotel employees to fully serve their customers, including one or more chefs, numerous waiters and/or waitresses, a hostess, a busboy, etc. Moreover, such full-service food facilities take up a considerable amount of space that must be maintained, as well as extensive furnishings, e.g., tables, chairs, and the like. Consequently, full-service restaurants involve a considerable capital investment, are highly labor intensive, and, at least in the case of many of those in mid-market hotels, unprofitable. Consequently, many such hotels have closed their full service eating facilities and, in some cases, installed food vending machines so their guests can at least find something to eat on the premises.

SUMMARY OF THE INVENTION

It is an objective of the present invention to offer a viable alternative to no full-service food facility whatsoever and vending machines, that is cost effective, capable of being installed quickly and efficiently, and is attractive to people on the go.

To achieve this objective and other advantages, and in accordance with the purpose of the present invention as embodied and broadly described, one aspect of the invention is directed to a method for establishing a variety of food courts at a plurality of installation sites that includes the steps of providing a plurality of food court sets, each set including a predetermined number of different, freestanding, food/beverage modules; equipping the modules of each food court set to serve a unique food/beverage product; generating a separate food court layout appropriate to each installation site; selecting from each of the food court sets those modules specified by the food court layout for each installation site; and arranging the selected modules at each installation site in accordance with the food court layout appropriate thereto.

Other aspects of the invention are directed to food court systems achieved as a result of practicing the above method.

Additional features and advantages of the invention will be set forth in the description which follows, and in part will be apparent from the description, or may be learned by practice of the invention. The objectives and other features of the invention will be realized and obtained by the method and system particularly pointed out in the written description and the claims hereof, as well as the appended drawings.

It will be appreciate that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute a part of this specification, illustrate several embodiments of the invention and, together with the description, serve to explain the principles of the invention.

As seen in the accompanying drawings.

Corresponding reference numerals refer to like parts throughout the several views of the drawings.

DETAILED DESCRIPTION OF THE PREFERRED EMBODIMENTS

The method of the present invention evolved from a need to replace costly full-service restaurants, such as those in mid-market hotels, with food court systems that serve fast food products. To minimize manufacturing and installation costs of the food courts, a limited number of different categories of food and beverage products were identified that should be universally acceptable to customers regardless of geographical location. Then, in accordance with the present invention, a separate, freestanding module is provided that is specially equipped and designed to serve the identified food/beverage product in each category. The modules serving the food/beverage products in each category then comprise a food court set.

Once locations are identified in which the food court systems are to be installed, food court layouts, appropriate to each of the installation sites, are then generated. These food court layouts would typically vary in arrangement due to different configurations of the space available at each installation site. Space limitations at particular installation sites may preclude a particular food court system from accepting customized food/beverage service modules in all of the categories, i.e., a full food court set. Also, local tastes or anticipated low patronage may dictate that less than a complete food court set of food/beverage service modules, i.e., one from each of the food/beverage categories, be installed at a particular installation site. Consequently, in accordance with the present invention, service modules are selected from food court sets as specified by the food court layout appropriate for each installation site.

Once a food court system is installed at an installation site by arranging the service module according to the food court layout appropriate therefor, only a minimal number of operating personnel, certainly fewer than the number of food/beverage service modules in the food court system, will be required to prepare and serve the various food and beverage products. Since service modules can be readily added and/or subtracted from a food court system, even after installation, ultimate flexibility can be achieved.

Figure 1:
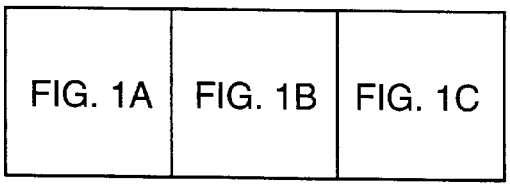
FIGS. 1A, 1B, and 1C, when arranged side-by-side in the manner shown in FIG. 1, illustrate a plan view of a food court system created in accordance with an embodiment of the present invention.
Figure 1A:
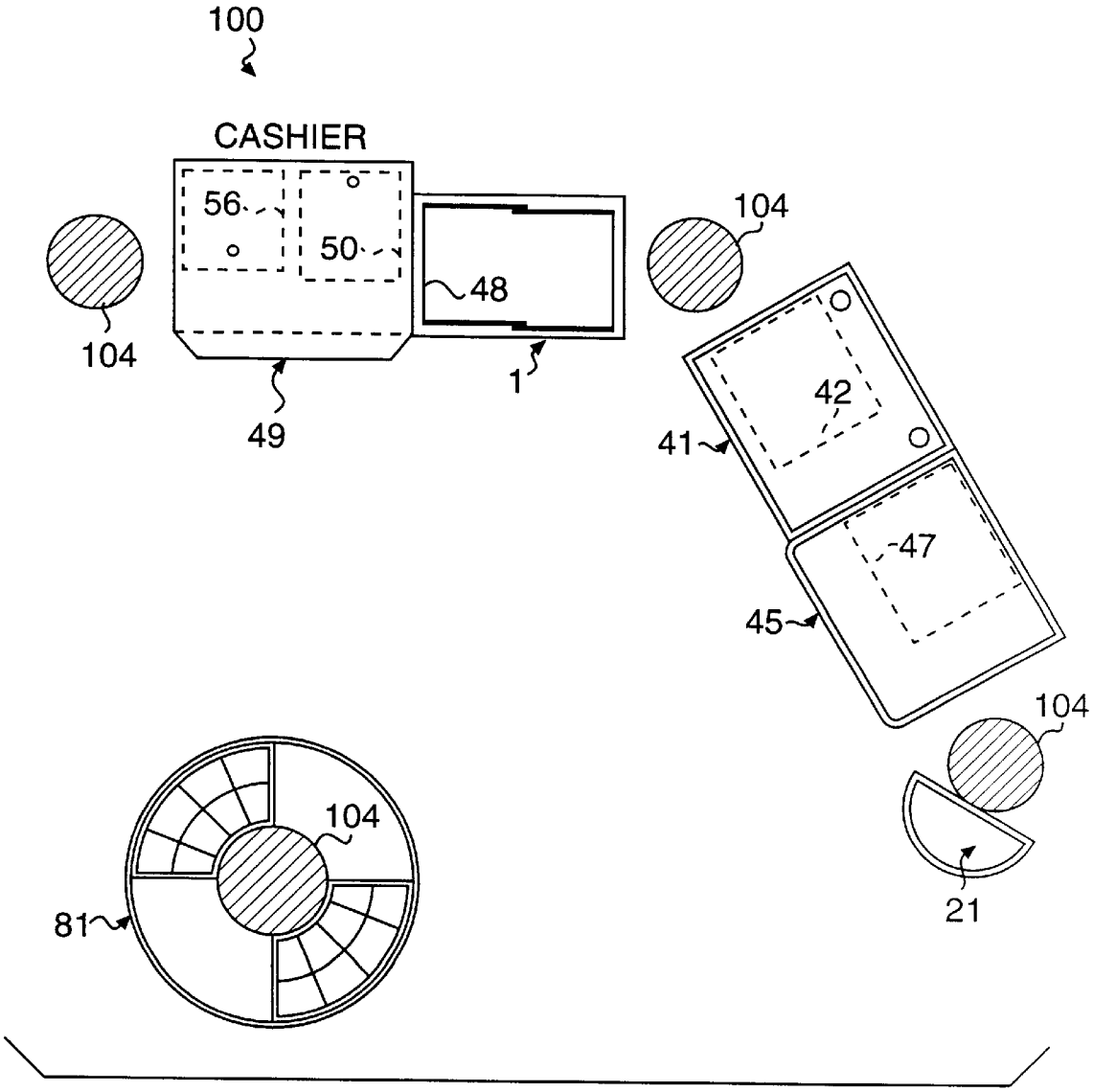
Figure 1B:
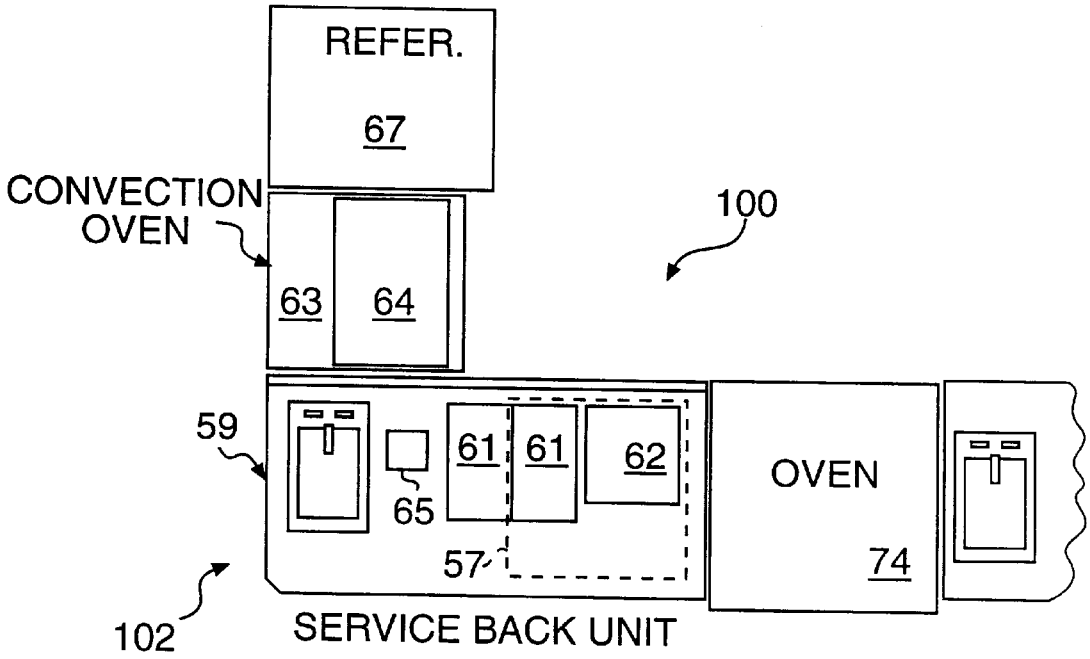
Figure 1B:
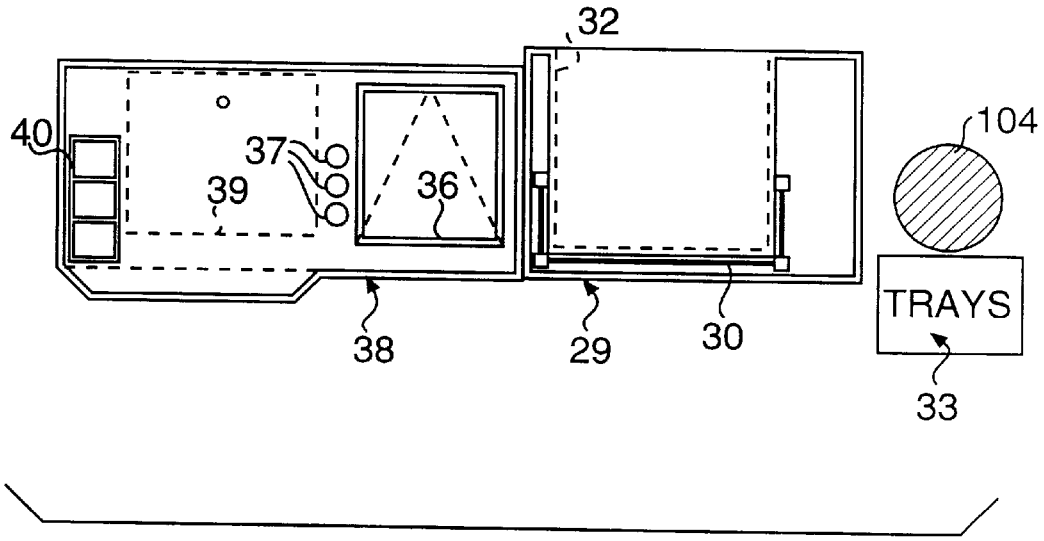
Figure 1C:
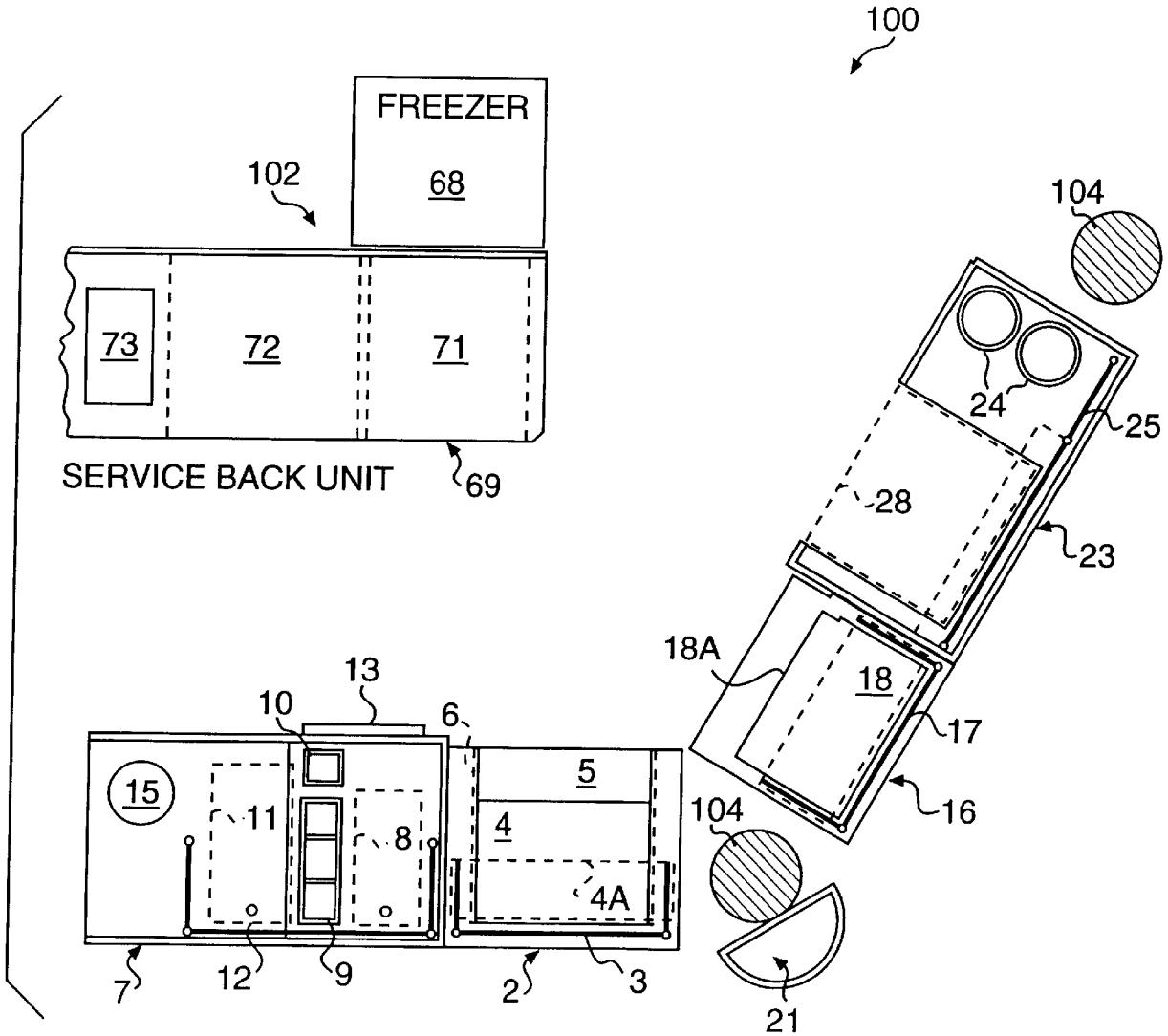

An example of a food court system achieved in accordance with the present invention is illustrated in FIGS. 1A, 1B and 1C when arranged side-by-side in alphabetical order, as shown in FIG. 1. The food court system, generally indicated at 100, includes a plurality of modules arranged in groups of juxtaposed pairs of modules according to a layout appropriate for the particular installation site. The portion of the food court system seen in FIG. 1A includes a cashier module 49 and a cold beverage service counter module 1 positioned in side-by-side, juxtaposed relation. A second pair of juxtaposed service modules 41 and 45 extend forwardly from the modules of 49 and 1 at a suitable oblique angle. Module 45, for example, may be specially equipped to serve hot beverages such as coffee, including speciality coffee drinks, hot coffee, tea, and the like. Module 41 may be equipped to serve bakery products such as cookies, tarts, pastries, and the like.

FIG. 1B illustrates that this portion of the food court system 100 includes juxtaposed modules 38 and 29. Module 38 may be specially equipped to prepare and serve dessert products, such as yogurt and ice cream, while module 29 may be equipped to serve deli products, such as sandwiches.

The remaining portion of the food court system 100 seen in FIG. 1C includes a juxtaposed pair of modules 7 and 2 and a pair of juxtaposed modules 16 and 23. Module 7 may be especially equipped to prepare and serve hot dogs, and module 2 may be equipped to serve pizzas. Module 16 may be equipped to serve a Mexican food product, while module 23 may be specially equipped to serve soups and salad.

As presently contemplated, the nine food/beverage service modules illustrated in FIGS. 1A–1C, plus the cashier counter module 49 constitute a complete food court set. Food court systems at other installations may comprise a lesser number of food/beverage service modules due to space constraints, local consumer tastes, and/or anticipated low consumer traffic. In addition to variations in numbers of food/beverage modules, food court systems at other installations may vary in layout and in the order in which the food/beverage modules are arranged, i.e., different layouts.

For those food court systems comprising a complete set of food/beverage modules, or at least a substantially complete set, a service back unit, generally indicated at 102 in FIGS. 1B and 1C, is preferably included. As illustrated in the drawings, back service unit 102 is centrally located in spaced relation behind the food/beverage service module layout and includes facilities shared by the various food/beverage modules. Thus, for example, the service back unit 102 may include a reach-in refrigerator 67, a reach-in freezer 68, an express cooking oven 74, and a counter-top convection oven 64. A modular beverage service counter, indicated at 59, may be equipped with several coffee brewers 61 and cappuccino/espresso machines (illustrated at 62 and 65). Reference numeral 69 indicates a food service counter equipped with a sink (not shown) and a grill 73. Reference numerals 57, 71 and 72, indicate undercounter refrigerators included with the beverage service counter 59 and the food service counter 69.

As noted above, these service back unit facilities are shared by all of the food/beverage service modules to accommodate storage, preservation, and preparation of the various beverage and food products unique to the individual modules.

Returning the descriptions of the various modules, cashier module 49 in FIG. 1A is equipped with a cash register 56 and perhaps a slush machine, as indicated at 50. The cold beverage service module 1 is equipped with a pass-through refrigerator 48 containing containers of various flavors of soft drink. Bakery service module 41 is equipped with a display case 42, while hot beverage service module 45 may be equipped with a coffee brewing unit, indicated at 47. The dessert service module 38, seen in FIG. 1B, may be equipped with an ice cream merchandiser 36, cup dispensers 37, an undercounter soft-service freezer 39, and toppings dispensers 40. Deli service module 29 is equipped with a protective case 30 containing food products such as sandwiches, and reference numeral 32 indicates an undercounter freezer.

The hot dog service module 7 seen in FIG. 1C may be equipped with a hot dog roller 11 for preparing the hot dogs, a french fry warmer 8, toppings wells 9 and 10, an undercounter bun warmer 13, and an undercounter induction range 15. Reference numeral 12 indicates a protective case. Pizza service module 2 is equipped with a sneeze guard 3, a heated shelf 4, an overhead warmer 4A, a cutting board 5, and an undercounter refrigerator 6.

Still referring to FIG. 1C, Mexican food service module 16 includes a protective case 17, a heated shelf and overhead warmer respectively indicated at 18 and 18A. The last of the full complement of food/beverage service modules, service module 23, may be equipped with a protective case 25, soup wells 24, and a salad top refrigerator indicated at 28.

The food/beverage modules are essentially of the same height, within several inches, and comparable in depth. The modules are basically of two different widths or lengths in terms of the food court layout. Modules 7, 23 and 38 are representative of the "wide" modular size that may vary in actual length dimension by several inches, while modules 1, 41, 29, 2, and 16 are representative of the "narrow" modular width, again varying in length by several inches in some cases.

Figure 2A:
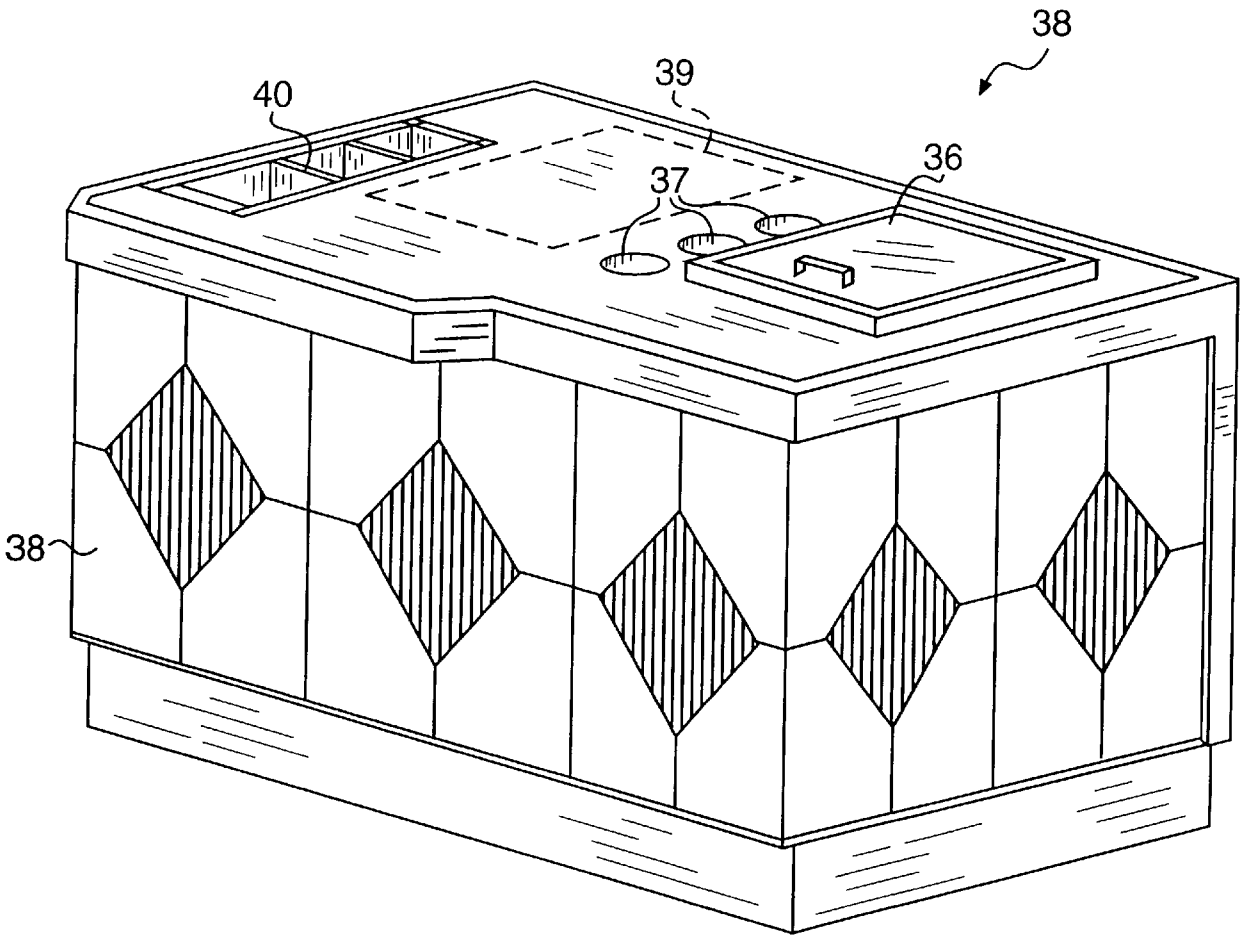
FIGS. 2A and 2B are front and back isometric views, respectively, of one of the service modules included in the food court system of FIGS. 1A–1C.
Figure 2B:
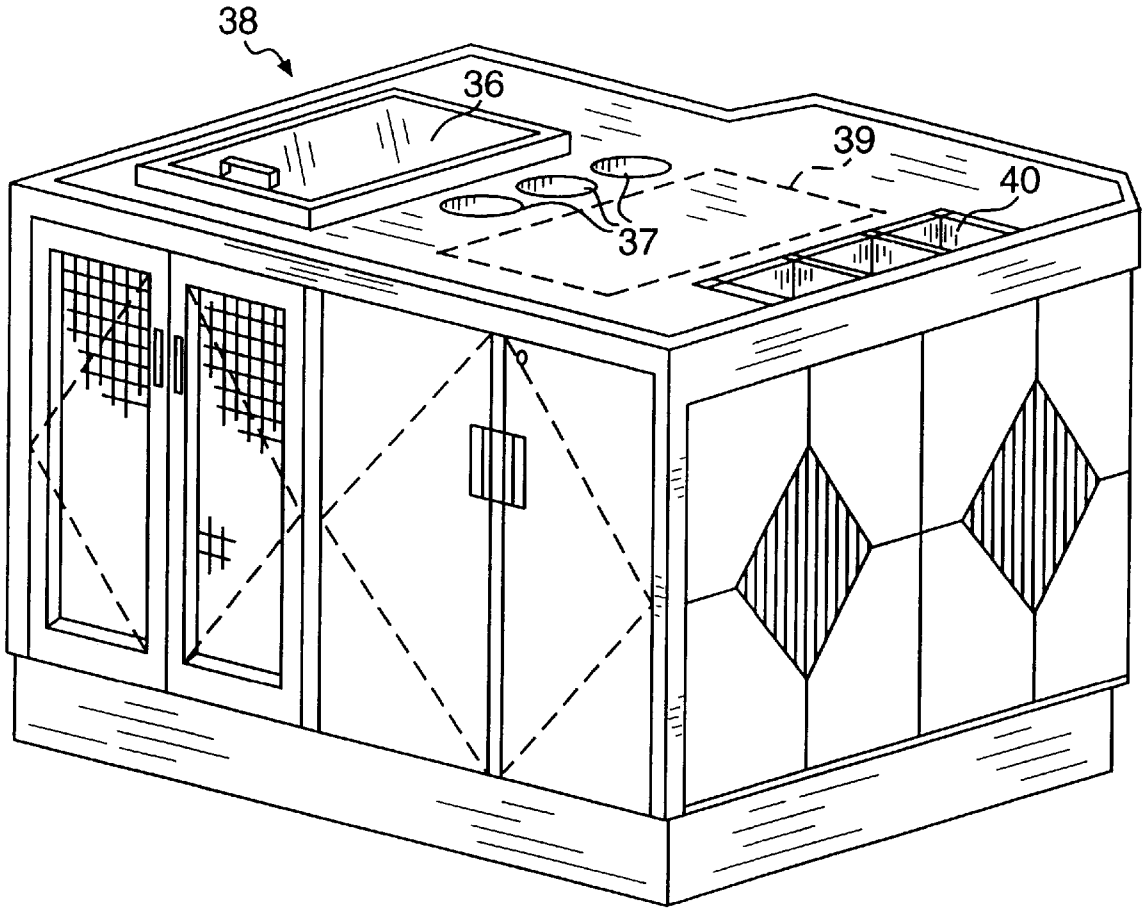

The various food/beverage service modules are basically cubical counter-type units that are equipped and configured to at least serve their particular products. For example, FIGS. 2A and 2B illustrate front and back isometric views, respectively, of the dessert service module 38 seen in the plan view of FIG. 1B. The front and sides of this module, as the other modules, are decoratively finished in a suitable manner, such as with tiles, to permit random positioning at any location in the food court layout. Thus, the modules can be randomly paired together in juxtaposition, as illustrated in FIGS. 1A–1C, without regard to possibly exposing unfinished sides.

In food court system 100 seen in FIGS. 1A–1C, the modules are arranged in a layout such as to provide separated groups of juxtaposed pairs of modules. The gaps between module pairs provide spaces for the positioning of freestanding, decorative columns 104.

Figure 3:
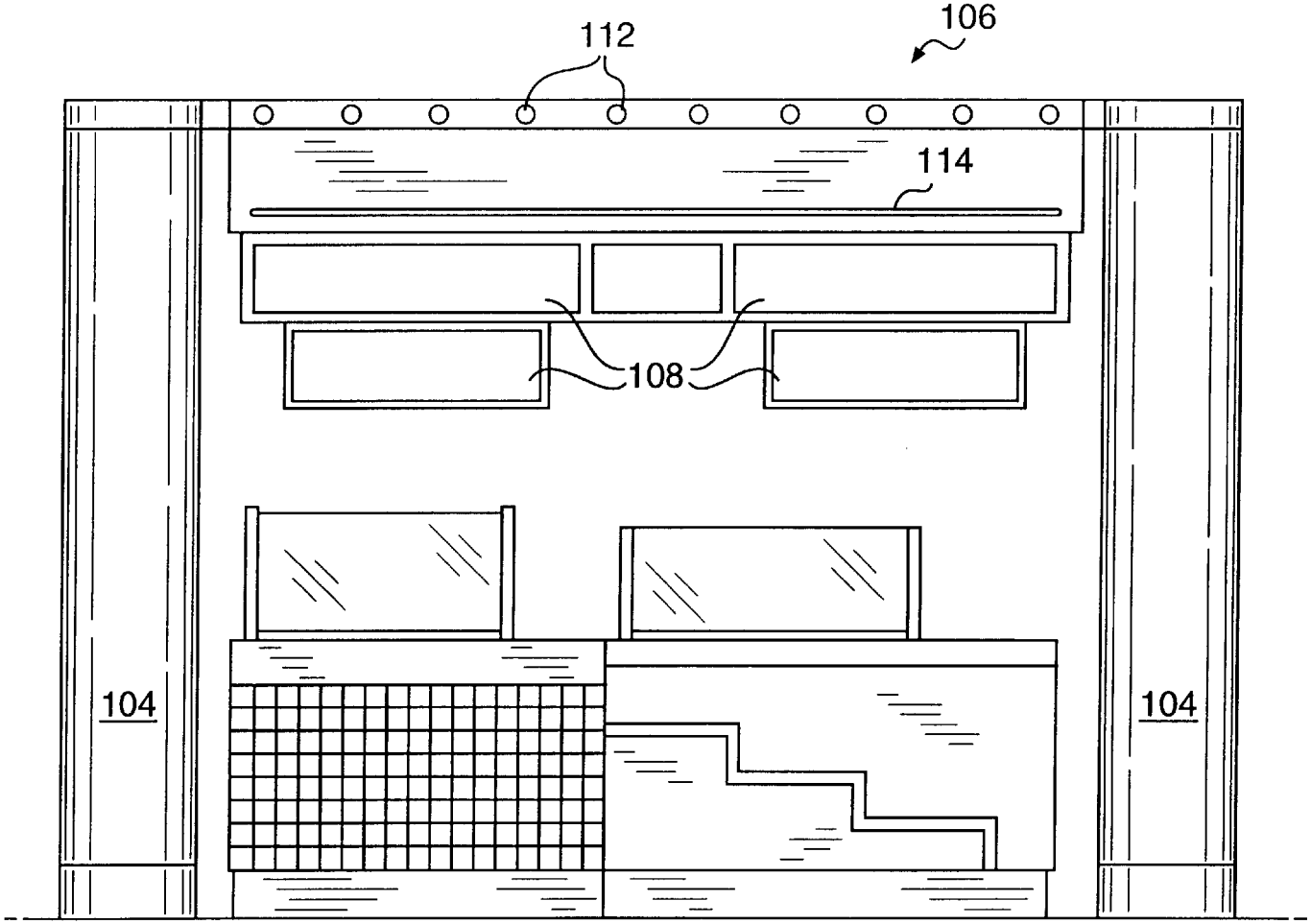
FIG. 3 is a front elevational view of a section of the food court system of FIGS. 1A–1C.

As illustrated in FIG. 3, adjacent pairs of these columns 104 are advantageously utilized to mount an elongated soffit unit 106 in elevated relation to the juxtaposed pair of modules positioned between the columns. These soffit units are equipped to detachably mount separate signs 108 directly overhead of the juxtaposed pair of modules to indicate the particular food/beverage products being served below. Reference numerals 112 and 114 indicate various types of lighting fixtures carried by the soffit unit in positions to appropriate illuminate the signs. Weights are preferably added to the bases of the columns so that they may be installed as freestanding modular stanchions.

As illustrated in FIGS. 1A–1C, these columns also may serve to mount display racks 21 for snack items such as potato chips, pretzels, etc., and a shelf for mounting trays, as indicated at 33. Then, as indicated in FIG. 1A, another one of the these freestanding columns 104 may be positioned forwardly of the cashier module 49 and equipped to mount a condiment counter 81.

It is seen from the foregoing description that the present invention provides a method of expeditiously installing food court systems at various installations sites where the installed systems can then provide cost effective food service in a fast food, manner. By limiting the maximum number of different food/beverage products that can be served by any food court system and by maintaining product source identity, the design, construction, and equipment features can be standardized for each module to save time and expense. Since the food court system modules are freestanding and not fixed in place, extreme flexibility is achieved in terms of the number of modules selected for inclusion in each food court system and their decorative arrangement at each installation site, all in a manner analogous to the selection and arrangement of furniture in a room. Moreover, this flexibility allows for convenient module additions to and subtractions from existing food court systems.

It will be apparent to those skilled in the art that various modifications and variations can be made in the food court method and system of the present invention without departing from the spirit or scope of the invention. Thus, it is intended that the present invention cover the modifications and variations thereof provided they come within the scope of the appended claims and their equivalents.

What is claimed is:

1. A method of establishing a variety of food court systems at a plurality of installation sites, the method comprising the steps of:

manufacturing a plurality of food court sets, each set including a predetermined number of different, freestanding, food/beverage modules;

equipping the modules of each food court set to serve a unique food/beverage product;

generating a separate food court layout associated with each installation site;

selecting from each of the food court sets modules for the food court layouts; and arranging the selected modules as food court systems at each installation site in accordance with the associated food court layout.

2. The method defined in claim 1, further including the step of providing a plurality of like, modular cashier counters and the step of positioning one of the modular cashier counters at each installation site in accordance with the associated food court layout.

3. The method defined in claim 2, further including the step of equipping one of the modules of each set to prepare the food/beverage product unique thereto.

4. The method defined in claim 3, further including the step of equipping a plurality of the modules in each set to refrigerate the food/beverage products unique thereto.

5. The method defined in claim 4, further including the step of equipping a plurality of the modules in each set to maintain a desired serving temperature of the food/beverage products unique thereto.

6. The method defined in claim 5, wherein the modules of each food court set that serve the same food/beverage product: are identically constructed and equipped.

7. The method defined in claim 6, further including the step of sizing the modules of each set, such that any pair of the modules of each set may be positioned in juxtaposed relation.

8. The method defined in claim 7, further including the step of sizing the modular cashier counters, such that any one of the modular cashier counters may be positioned in juxtaposed relation with any one of the modules.

9. The method defines in claim 7, further including the step of providing a plurality of modular stanchions for arrangement with the selected modules at each installation site in accordance with the associated food court layouts.

10. The method defined in claim 9, further including the step of positioning at least one juxtaposed pair of modules between an adjacent pair of the modular stanchions at each installation site.

11. The method defined in claim 10, further including the steps of:

providing a plurality of soffit units;

mounting one of the soffit units between the adjacent pair of modular stanchions in elevated relation to the juxtaposed pair of modules at each installation site; and detachedly mounting signs to the soffit units in overhead display positions to identify the unique food/beverage products served by the juxtaposed pair of modules.

12. The method defined in claim 8, further including the steps of:

positioning a service back unit in spaced relation behind the food court systems in at least some of the installation sites; and equipping the service back unit with facilities readily accessible to a plurality of the modules for storing, refrigerating, and/or preparing the food/beverage products unique thereto.

* * * * *